US009318799B2

(12) United States Patent
Rousu et al.

(10) Patent No.: US 9,318,799 B2
(45) Date of Patent: Apr. 19, 2016

(54) WIRELESS COMMUNICATION APPARATUS AND METHOD FOR CONTROLLING ANTENNA RADIATION PATTERNS BASED ON FADING CONDITIONS

(71) Applicant: Broadcom Corporation, Irvine, CA (US)

(72) Inventors: Seppo Olavi Rousu, Oulu (FI); Marko Autti, Oulu (FI)

(73) Assignee: BROADCOM CORPORATION, Irvine, CA (US)

( * ) Notice: Subject to any disclaimer, the term of this patent is extended or adjusted under 35 U.S.C. 154(b) by 213 days.

(21) Appl. No.: 13/853,220

(22) Filed: Mar. 29, 2013

(65) Prior Publication Data

US 2014/0295782 A1 Oct. 2, 2014

(51) Int. Cl.

| | |
|---|---|
| ***H01Q 3/00*** | (2006.01) |
| ***H01Q 1/32*** | (2006.01) |
| ***H01Q 1/48*** | (2006.01) |

(52) U.S. Cl.

CPC ..... *H01Q 1/3275* (2013.01); *H01Q 1/48* (2013.01); *H01Q 3/00* (2013.01)

(58) Field of Classification Search

CPC ..... H01Q 3/00; H01Q 1/3275; H01Q 1/48
USPC ..... 455/226.1
See application file for complete search history.

(56) References Cited

U.S. PATENT DOCUMENTS

| | | | | |
|---|---|---|---|---|
| 6,144,340 | A | 11/2000 | Kiiski et al. | |
| 6,229,481 | B1 | 5/2001 | Katz | |
| 6,392,595 | B1 * | 5/2002 | Katz et al. | 342/367 |
| 6,453,177 | B1 * | 9/2002 | Wong et al. | 455/562.1 |
| 7,117,014 | B1 * | 10/2006 | Van Rensburg et al. | 455/561 |
| 2003/0157897 | A1 * | 8/2003 | Maeda et al. | 455/67.3 |
| 2005/0124368 | A1 * | 6/2005 | Diao et al. | 455/522 |
| 2007/0057843 | A1 | 3/2007 | Chang et al. | |
| 2007/0093212 | A1 * | 4/2007 | Sugahara | 455/67.16 |
| 2009/0128411 | A1 * | 5/2009 | Sugahara et al. | 342/385 |
| 2010/0255803 | A1 * | 10/2010 | Sugahara et al. | 455/226.1 |
| 2010/0315289 | A1 * | 12/2010 | Nurmela et al. | 342/385 |
| 2011/0255619 | A1 * | 10/2011 | Nam et al. | 375/260 |
| 2012/0121034 | A1 * | 5/2012 | Murakami et al. | 375/295 |
| 2012/0320874 | A1 * | 12/2012 | Li et al. | 370/331 |
| 2013/0102322 | A1 * | 4/2013 | Nakamori et al. | 455/455 |
| 2013/0157660 | A1 * | 6/2013 | Awad et al. | 455/435.1 |
| 2013/0194950 | A1 * | 8/2013 | Haghighat et al. | 370/252 |
| 2013/0223251 | A1 * | 8/2013 | Li et al. | 370/252 |
| 2013/0234890 | A1 * | 9/2013 | Chethik et al. | 342/374 |
| 2014/0133322 | A1 * | 5/2014 | Steer et al. | 370/252 |
| 2014/0376455 | A1 * | 12/2014 | Autti et al. | 370/329 |

FOREIGN PATENT DOCUMENTS

| | | |
|---|---|---|
| EP | 1337047 | 8/2003 |
| WO | WO-99/23778 | 5/1999 |
| WO | WO-00/27148 | 5/2000 |

* cited by examiner

*Primary Examiner* — Bobbak Safaipour
*Assistant Examiner* — Devan Sandiford
(74) *Attorney, Agent, or Firm* — Oblon, McClelland, Maier & Neustadt, L.L.P

(57) ABSTRACT

Measures for fading-based control of an antenna radiation pattern. Such measures may comprise reception of at least one radio wave signal via an antenna unit, detection of fading conditions in relation to the received at least one radio wave signal, and control of an antenna radiation pattern of the antenna unit, at least in terms of antenna lobe width, on the basis of the detected fading conditions.

17 Claims, 9 Drawing Sheets

WIRELESS COMMUNICATION APPARATUS AND METHOD FOR CONTROLLING ANTENNA RADIATION PATTERNS BASED ON FADING CONDITIONS

CROSS REFERENCE TO RELATED APPLICATION

This application claims benefit under 35 U.S.C. §119(a) and 37 CFR 1.55 to UK patent application no 1206165.1, filed on 5 Apr. 2012, the entire content of which is hereby incorporated by reference.

TECHNICAL FIELD

The exemplary and non-limiting embodiments of these teachings relate to antenna control, for example controlling an antenna radiation pattern in an antenna module. In particular, but not exclusively, the exemplary, embodiments relate to methods, apparatuses, and computer readable medium for providing fading-based control of an antenna radiation pattern.

BACKGROUND

Typically, omnidirectional antennas are mostly used in contemporary (cellular) communication systems, especially at mobile devices such as vehicles and terminal equipments. The use of such omnidirectional antennas can lead to situations where a connection to a base station (such as a downlink wireless link) or to another mobile device (such as a D2D wireless link) is dropped or at least degraded due to degrading radio propagation properties of a wireless path, for example when operating on cell edges, especially in rural areas.

In view thereof it is beneficial to use directional antennas, particularly steerable antennas with variable antenna radiation pattern. The use of such (steerable) directional antennas can enable an improved directivity towards a communication counterpart such as a base station or another mobile device, thereby avoiding connection drop or connection degradation.

However, controlling the directivity of the antenna radiation pattern towards a communication counterpart may not be sufficient for achieving desirable reception or radio link performance, for example in terms of reception sensitivity of a desired radio wave signal/s and/or reception data throughput and/or envelope correlation between MIMO reception signals in case of a MIMO antenna unit. Whilst this is generally the case for any mobile environment, corresponding problems in view of degraded reception or radio link performance are particularly challenging in environments, such as automotive environments, where a mobile device, such as a vehicle, where the antenna in question is moving reasonably fast in varying environments.

Thus, there is a desire to provide for control of an antenna radiation pattern which is capable of providing improved reception or radio link performance even for mobile devices moving in varying environments.

SUMMARY

According to a first exemplary aspect of the invention, there is a method of controlling an antenna radiation pattern in an antenna module. The method comprising receiving at least one radio wave signal via an antenna unit, detecting fading conditions in relation to the received at least one radio wave signal, and the detecting including determining a predefined fading scenario. The method further comprises controlling an antenna radiation pattern of the antenna unit in terms of antenna lobe width on the basis of the detected fading conditions, the controlling including adjusting the antenna lobe width in accordance with the determined fading scenario, wherein the predefined fading condition includes a line-of-sight (LOS) scenario and at least one scattering non-line-of sight (NLOS) scenario.

According to a second exemplary aspect of the invention, there is an apparatus for use in controlling an antenna radiation pattern in an antenna module. The apparatus including at least one processor, and at least one memory including computer program code, the at least one memory and the computer program code being configured to with the at lost one processor, cause the apparatus at least to receive at least one radio wave signal via an antenna unit, detect fading conditions in relation to the received at least one radio wave signal, and the detecting including determining a predefined fading scenario. The at least one memory and the computer program code are configured, with the at least one processor, to further cause the apparatus at least to control an antenna radiation pattern of the antenna unit in terms of antenna lobe width on the basis of the detected fading conditions, the controlling including adjusting the antenna lobe width in accordance with the determined fading scenario, wherein the predefined fading scenario includes a line-of-sight (LOS) scenario and at least one scattering non-line-of-sight (NLOS) scenario.

According to a third exemplary aspect of the invention, there is a non-transitory computer-readable medium including computer readable instructions stored thereon, the computer readable instructions being executable by a processor to cause the processor to at least receive at least one radio wave signal via an antenna unit, detect fading conditions in relation to the received at least one radio wave signal, and the detecting including determining a predefined fading scenario. The computer readable instructions being executable by the processor further cause the processor to control an antenna radiation pattern of the antenna unit in terms of antenna lobe width on the basis of the detected fading conditions, the controlling including adjusting the antenna lobe width in accordance with the determined fading scenario, wherein the predefined fading scenario includes a line-of-sight (LOS) scenario and at least one scattering non-line-of-sight (NLOS) scenario.

Further developments or modifications of the aforementioned aspects of these teachings are set out in the following.

By virtue of any one of the aforementioned aspects of these teachings, there is provided a control of an antenna radiation pattern, which is capable of providing for improved reception or radio link performance even for mobile devices moving in varying environments.

Thus, by way of exemplary embodiments of these teachings, enhancements and/or improvements are achieved by measures for realizing fading-based control of an antenna radiation pattern.

BRIEF DESCRIPTION OF DRAWINGS

For a more complete understanding of embodiments of these teachings, reference is now made to the following description taken in conjunction with the accompanying drawings in which.

DETAILED DESCRIPTION

Figure 1:
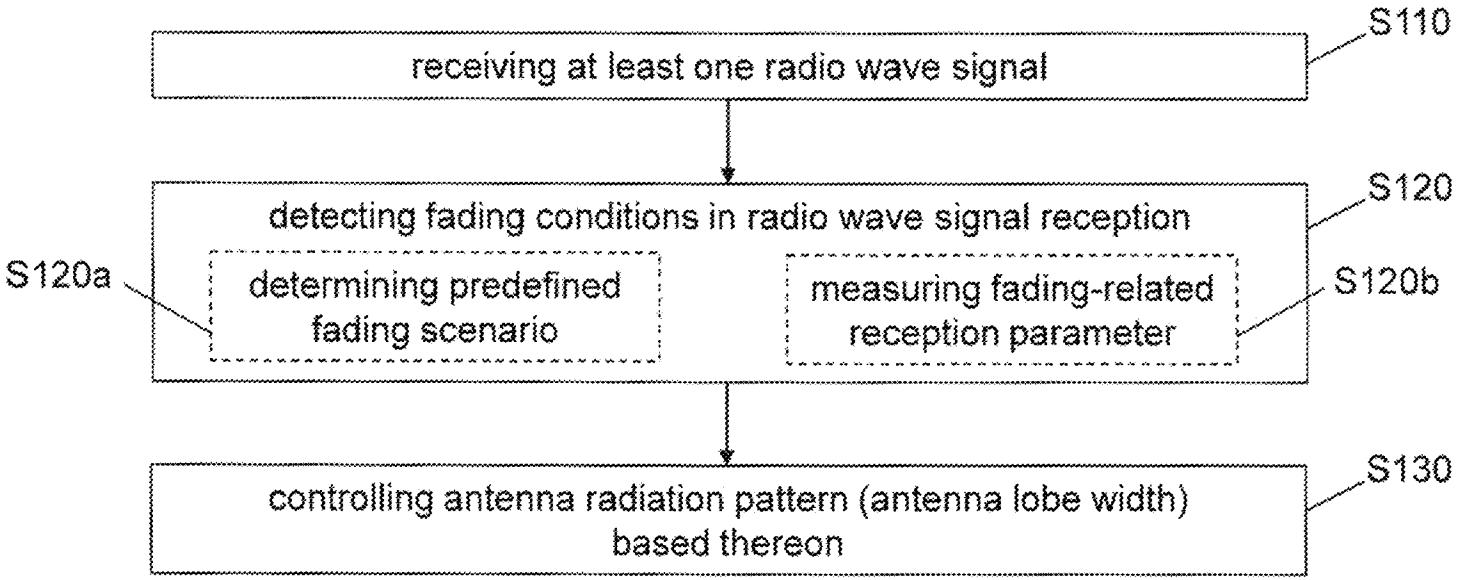
FIG. 1 shows a flowchart of a first procedure according to exemplary embodiments of these teachings.

Aspects of the present disclosure will be described herein below. More specifically, aspects of the present disclosure are described hereinafter with reference to particular non-limiting examples. A person skilled in the art will appreciate that these exemplary embodiments are by no means limited to these examples, and may be more broadly applied.

It is to be noted that the following description of the present disclosure and its embodiments mainly refers to explanations being used as non-limiting examples for exemplifying purposes. As such the description of embodiments given herein specifically refers to terminology which is related thereto. Such terminology is only used in the context of the presented non-limiting examples, and naturally does not limit the present disclosure in any way.

In particular, the present disclosure and its embodiments may be applicable to any antenna in any use case scenario or operational scenario, for which directivity properties are desirable, including application areas of mobile communications as well as radar, network measurements, network positioning measurements, satellite positioning and satellite communications, interference reduction, for example. Antenna use case scenarios in the meaning of the present disclosure and its embodiments may appear in computers, PCs, communication devices with user interface(s), communication devices without user interlaces, vehicles, ears, relays, routers, base stations, satellites etc., when having capability for radio communication with a communication counterpart such as for example networks, ad hoc wireless networks, satellites, alternate terminals, any other communication equipment or the like.

Hereinafter, various embodiments and implementations of the present disclosure and its aspects or embodiments are described using several alternatives. It is generally noted that, according to certain needs and constraints, all of the described alternatives may be provided alone or in any conceivable combination (also including combinations of individual features of the various alternatives).

According to embodiments, in general terms, there are provided measures for realizing fading-based control of an antenna radiation pattern.

More specifically, embodiments provide for a technique for controlling an antenna radiation pattern (at least in terms of antenna lobe width), such as for controlling beamforming, wherein the antenna radiation pattern is adjusted or stated in other words, the antenna beam is formed (at least in terms of antenna lobe width) according to fading conditions in reception of at least one radio wave signal.

By virtue of a fading-based control of an antenna radiation pattern according to embodiments, the antenna radiation pattern can be varied to be as optimal as possible for maintaining acceptable reception or radio link performance, for example in terms of reception sensitivity of a desired radio wave signal and/or reception data throughput and/or envelope correlation between MIMO reception signals in case of a MIMO antenna unit.

The fading-based control of an antenna radiation pattern (such as the lading-based beamforming technique) according to embodiments relies on the following considerations.

Signal propagation conditions on a radio link alter according to fading conditions prevailing between the transmitting and receiving counterparts. In radio reception, the fading conditions can be divided into line-of-sight (LOS) conditions and scattering (non-line-of-sight NLOS) conditions. In the time domain, LOS (radio reception) conditions alter slowly, because there is typically a direct link between the communication counterparts, such as LIE/vehicle and base station or different UEs/vehicles. In contrast thereto, NLOS (radio reception) conditions alter rapidly due to multiple reflections, for example in urban canyons.

In this regard, it is challenging in terms of reception or radio link performance (in particular, reception data throughput), when reflections arrive at angles of (approximately) 360 degrees around the CT/vehicle and/or the received power of desired signals is low (compared to undesired signals such as noise and/or interference). Operating on rich scattering environments, especially in urban canyons or similar environments, can lead to a situation where maximum data throughput is not achieved in reception, such as for example MIMO reception, because data signals are not received with a sufficiently high SNR and/or decorrelation of MIMO signals.

Further, it is challenging in terms of reception or radio link performance (in particular, reception sensitivity), when the received power of desired signals is low (as compared to undesired signals such as noise and/or interference). In embodiments, in order to achieve good cell coverage or, more generally, communicable distance, the antenna lobe width is narrow. Operating on cell edges, especially in suburban and rural areas or similar environments, can lead to a situation where the connection to a base station or another communication counterpart is dropped.

In view of the above, the fading-based control of an antenna radiation pattern according to embodiments enables the antenna radiation pattern to be modified according to fading conditions. Further, the fading-based control of an antenna radiation pattern according to embodiments enables the antenna radiation pattern to be modified to give the best directivity towards a communication counterpart. Thereby, improvements in reception or radio link performance, for example in terms of reception sensitivity of a desired radio wave signal and/or reception data throughput and/or envelope correlation between MIMO reception signals in case of a MIMO antenna unit, could be achieved. As used herein, reception data throughput may cover performance of the whole communication link including radio channel, antenna, RF and Modem BB processing.

In the following, embodiments are described with reference to methods, procedures and functions, as well as with reference to structural arrangements and configurations.

FIG. 1 shows a flowchart of a first procedure according to exemplary embodiments.

FIG. 1 includes an operation (S110) of receiving at least one radio wave signal via an antenna unit, an operation (S120) of detecting fading conditions in relation to the received at least one radio wave signal and an operation (S130) of controlling an antenna radiation pattern of the antenna unit in terms of antenna lobe width on the basis of the detected fading conditions.

In communication scenarios with at least two radio wave signals, the signals may be at the same frequency band allocation, at the same frequency range (for example 1 GHz, 2 GHz, 2.6 GHz, 3.4 GHz) but from different frequency band allocations, or from different frequency ranges. Furthermore, with at least two radio wave signals, there may be one or more communication counterparts by which the received radio wave signals have been transmitted. For example a single base station, more than one base station, at least one base station and at least one UE or other mobile device, and so on. A communication radio link with at least two radio wave signals may for example be used for carrier aggregation in LTE-A or HSPA, for alternate radio access technologies (such as for example LIE and WiFi), or between different radio access technologies (such as for example LTE and WiFi). Further, embodiments are applicable for both TDD and FDD radio communication systems.

According to embodiments, the fading conditions in reception may include any information or parameter indicative of signal propagation conditions on a radio link between the antenna unit in question (which may be mounted/mountable at any mobile device, such as a UE or a vehicle) and a communication counterpart (which may be another UE or vehicle or any kind of communication system infrastructure such as a base station or access node). Such fading-related information or parameter may exemplarily relate to received signal power or dispersion thereof and/or signal delay or spread/dispersion thereof and/or signal direction or dispersion thereof (including both TX and or RX signal direction), Doppler frequency or dispersion thereof, polarization or dispersion thereof, small-scale fading or dispersion thereof, etc.

In embodiments, the antenna radiation pattern is controllable (at least) in terms of antenna lobe width according to fading conditions in reception. Controlling antenna lobe width is achievable with information about current fading conditions, which is available for example from a modem receiver and/or a processor. Namely, the relevant information about current fading conditions may be extracted from the received radio wave signal or signals by algorithms in/at a modem receiver and/or a processor. Thus, extracted information can then be used to control an antenna radiation pattern in terms of (at least) antenna lobe width according to prevailing fading conditions.

As indicated in FIG. 1 by way of a dashed line box, in a procedure according to embodiments, the detection operation may include an operation (S120*a*) of determining a predefined fading scenario, wherein the control operation may include adjusting the antenna lobe width in accordance with the determined fading scenario. In this regard, the predefined fading scenario may include a line-of-sight (LOS) scenario and at least one scattering (NLOS) scenario.

In the operation S120*a*, the detected fading conditions may be evaluated so as to distinguish between LOS and NLOS fading scenarios. When a LOS fading scenario is determined, antenna control in operation S130 may be such that the antenna radiation pattern is controlled in such a manner that the antenna lobe width is adjusted to form a narrow beam width (towards an incoming signal direction), for example between 0 and 90 degrees. When a NLOS fading scenario is determined, antenna control in operation S130 may be such that the antenna radiation pattern is controlled in such a manner that the antenna lobe width is adjusted to form a wide beam width (towards an incoming signal direction), for example between 180 and 360 degrees. The difference between the two cases of antenna control in LOS and NLOS cases is exemplarily illustrated in FIG. 4 which shows an antenna diagram illustrating two antenna radiation patterns resulting from a control according to embodiments.

As indicated in FIG. 1 by way of a dashed line box, in a procedure according to embodiments, the detection operation may include an operation (S120*b*) of measuring at least one fading-related reception parameter, wherein the control operation may include adjusting the antenna lobe width in accordance with the measured at least one fading-related reception parameter. In this regard the at least one fading-related reception parameter may include at least one of any conceivable parameters indicative of signal propagation conditions on a radio link between the antenna unit and a communication counterpart and/or at least one antenna parameter of the antenna unit. For example, the at least one fading-related reception parameter may include a delay spread of the received at least one radio wave signal and or a least one of a parameter indicative of a received power of the received at least one radio wave signal and/or at least one antenna parameter of the antenna unit.

In the operation S120*b*, the antenna control may correlate with individual values of the measured fading-related reception parameter or parameters, or may correlate with predefined ranges/intervals thereof. For example, when the delay spread of the received at least one radio wave signal is measured as the fading-related reception parameter, the antenna control may be adapted on a value basis or a range/interval basis of the thus measured delay spread. When a medium delay spread (of scattered signals) is measured, antenna control in operation S130 may be such that the antenna radiation pattern is controlled in such a manner that the antenna lobe width is adjusted to form a medium beam width (towards an incoming signal direction), for example between 80 and 180 degrees. When a large delay spread (of scattered signals) is measured, antenna control in operation S130 may be such that the antenna radiation pattern is controlled in such a manner that the antenna lobe width is adjusted to form a wide beam width (towards an incoming signal direction), for example between 180 and 360 degrees.

According to embodiments, the detection operation may include one or both of the operations S120*a* and S120*b* set out above.

When both operations S120*a* and S120*b* are applied for detection of fading conditions according to embodiments the fading-related reception parameter may be associated with the determined fading scenario.

For example when a LOS fading scenario is determined, no measurement of a fading-related reception parameter may be performed, and the antenna radiation pattern may be controlled on the basis of the determined fading scenario only for example by adjusting the antenna lobe width to form a beam width of (around) 45 degrees. When a NLOS fading scenario is determined, measurement of a delay spread as a fading-related reception parameter may be performed, and the antenna radiation pattern may be controlled on the basis of the combination of the determined fading scenario and the measured delay spread, for example by adjusting the antenna lobe width to form a beam width of between 90 and 135 degrees or between 135 and 180 degrees in the case of a medium delay spread of scattered signals, and by adjusting the antenna lobe width to form a beam width of between 180 and 360 degrees or (approximately) 360 degrees in the case of a large delay spread of scattered signals.

In both alternatives, that is when operation S120*b* is implemented with or without combination with operation S120*a*, the measured fading-related reception parameter may be any parameter indicative of fading-related reception characteristics at the antenna unit in question, in addition or as an alternative to the aforementioned delay spread, a parameter indicative of a received power of the received at least one radio wave signal may be used. Such a parameter may for example include one or more of SNR, SIR, SINR, UL/DL signal power, RSSI, and the like. Further, in addition or as an alternative to the aforementioned delay spread, at least one antenna parameter of the antenna unit in question may be used. Such a parameter may for example include a number of antenna elements (radiators), an arrangement of antenna elements (radiators) in an antenna array current weights of antenna elements (radiators), and the like.

Figure 2:
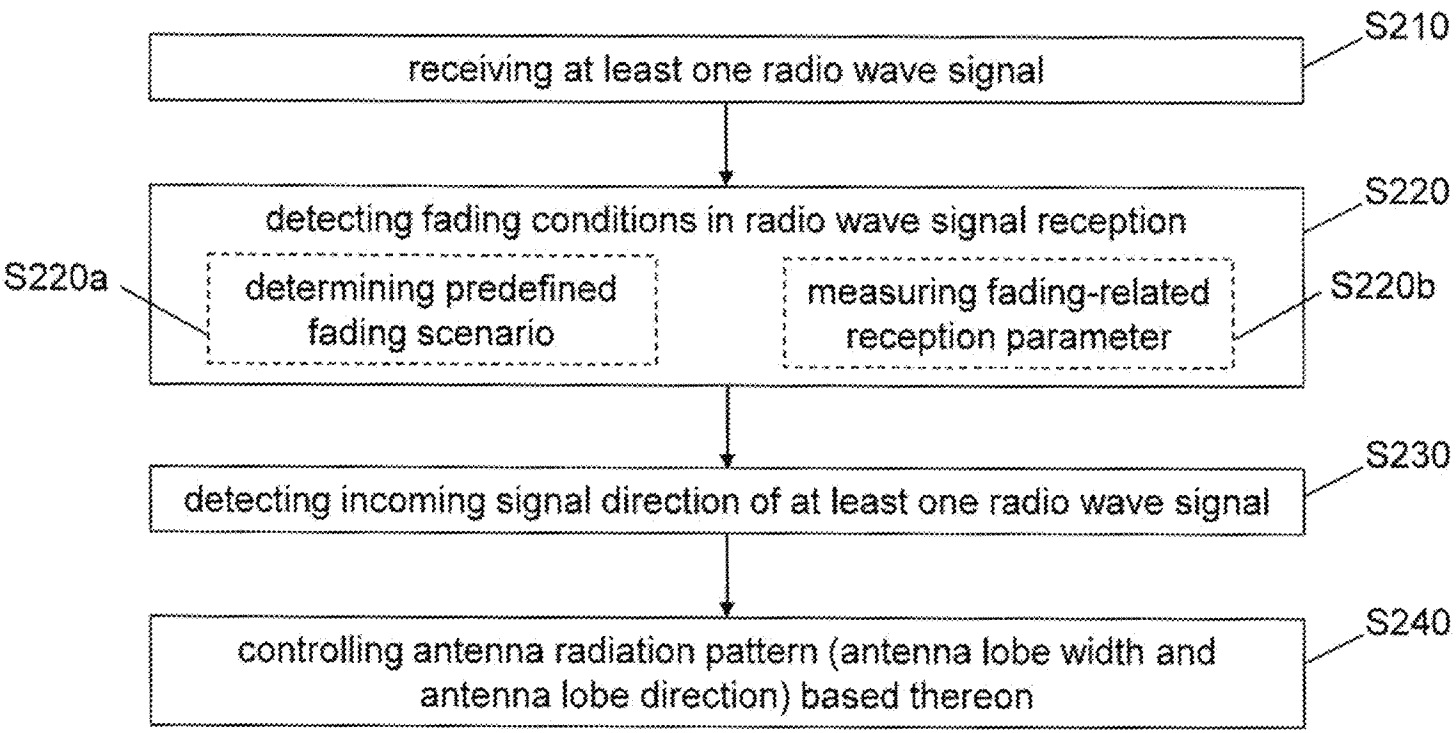
FIG. 2 shows a flowchart of a second procedure according to exemplary embodiments of these teachings.

FIG. 2 shows a flowchart of a second procedure according to embodiments. The operations S210 and S220 (potentially including S220*a* and/or S220*b*) of FIG. 2 correspond to operations S110 and S120 (potentially including S120*a* and/or S120*b*) of FIG. 1. Accordingly, no detailed description thereof is repeated hereinafter, but reference is made to the corresponding description in conjunction with FIG. 1 above.

As shown in FIG. 2, a procedure according to embodiments includes, in addition to operations S210 and S220 (potentially including S220*a* and/or S220*b*), an operation (S230) of detecting an incoming signal direction in relation to the receipt of at least one radio wave signal. The control operation (S240) includes controlling the antenna radiation pattern of the antenna unit in terms of antenna lobe direction on the basis of the detected incoming signal direction, in addition to controlling an antenna radiation pattern of the antenna unit in terms of antenna lobe width on the basis of the detected fading conditions (as in operation S130 of FIG. 1).

It is to be noted that the sequence of operation S220 and S230 illustrated in FIG. 2 is an example only. Alternatively, these operations may be performed in a different sequence or in parallel that is (quasi) at the same time.

Figure 3:
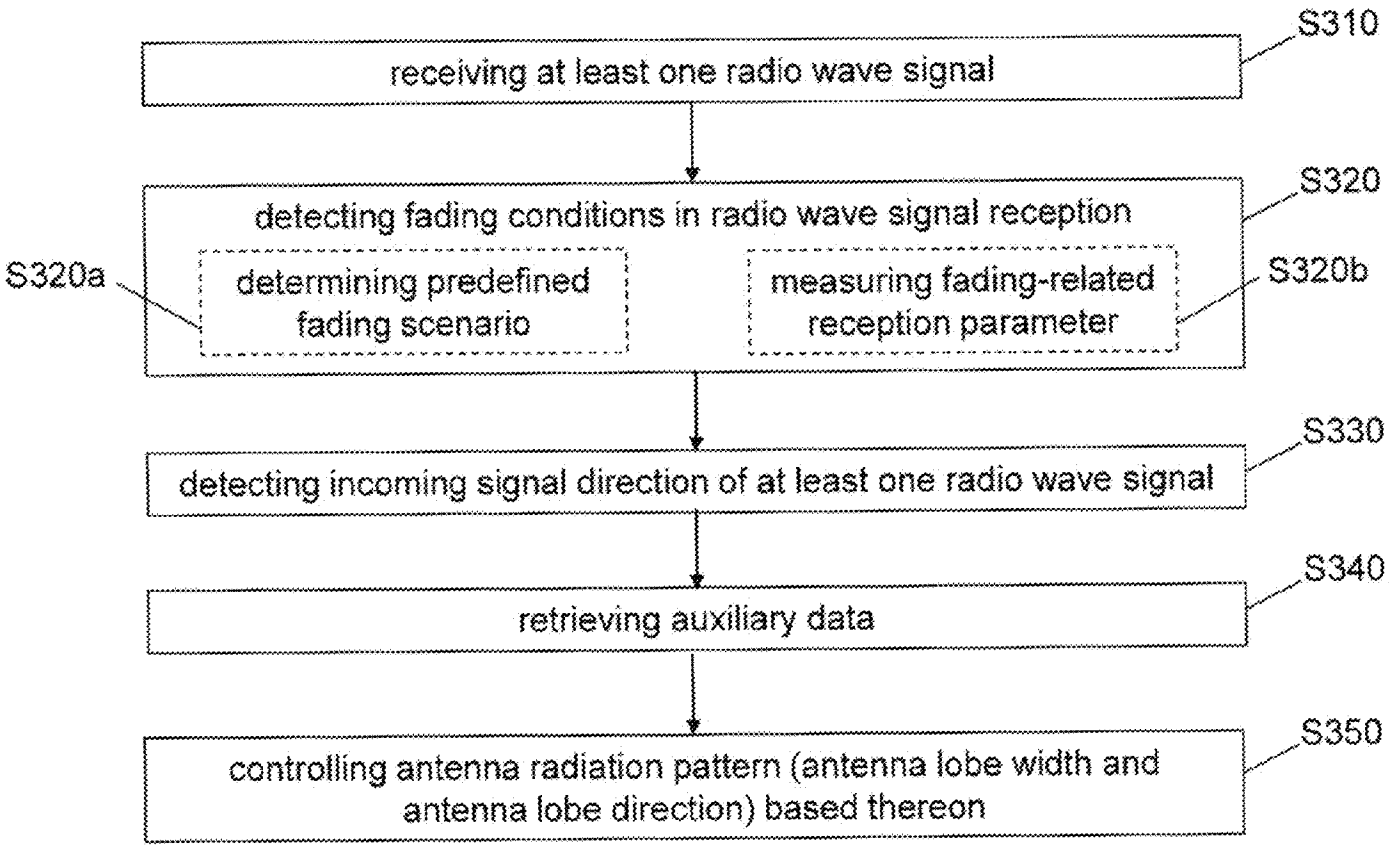
FIG. 3 shows a flowchart of a third procedure according to exemplary embodiments of these teachings.

FIG. 3 shows a flowchart of a third procedure according to embodiments. Basically, the operations S310. S320 (potentially including S320*a* and/or S320*b*) and S330 of FIG. 3 correspond to operations S210, S220 (potentially including S220*a* and/or S220*b*) and S230 of FIG. 2. Accordingly, no detailed description thereof is repeated hereinafter, but reference is made to the corresponding description in conjunction with FIGS. 1 and 2 above.

As shown in FIG. 3, a procedure according to embodiments includes, in addition to operations S310, S320 (potentially including S220*a* and/or S220*b*) and S330, an operation (S340) of retrieving auxiliary data relating to at least one of geographical and infrastructural environment information. The control operation (S350) includes controlling the antenna radiation pattern of the antenna unit in terms of antenna lobe width and/or antenna lobe direction on the basis of the retrieved auxiliary data, in addition to the basis of the detected fading conditions and/or the detected incoming signal direction (as in operation S130 of FIG. 1 or operation S240 of FIG. 2).

The auxiliary data relating to at least one of geographical and infrastructural environment information may for example include information regarding the geographical position of base stations of a cellular communication system, positions where mobile devices (such as the mobile device with the antenna unit in question and/or a mobile device representing a communication counterpart) may or are likely to be positioned. Such information may be retrieved from a local storage or via communication with a communication counterpart. For example, in a use case of D2D communication between two vehicles representing mobile devices, roadmap and/or road design data (potentially including characteristics of straight roads, curves, clothoids, or the like) may be used as auxiliary data, which may fir example be retrieved from a local navigation device or a cloud-based navigation system.

It is to be noted that the sequence of operations S320 to S340 illustrated in FIG. 3 is an example only. Alternatively, these operations may be performed in a different sequence or (at least partly) in parallel, that is (quasi) at the same time.

According to embodiments, a hysteresis approach may be adopted in controlling the antenna radiation pattern in any one of operations S130, S240 and S350, respectively.

Figure 4:
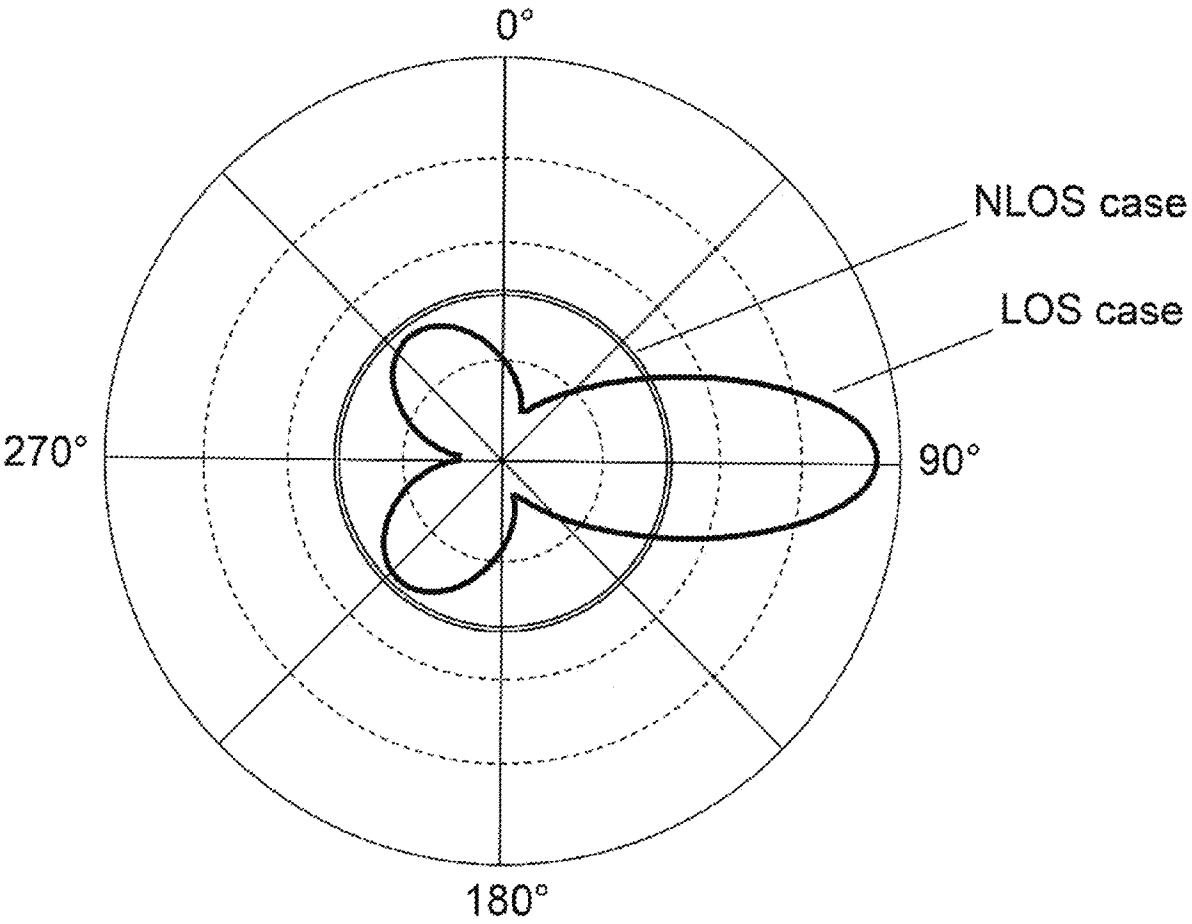
FIG. 4 shows an antenna diagram illustrating two antenna radiation patterns resulting from a control according to exemplary embodiments of these teachings.

FIG. 4 shows an antenna diagram illustrating two antenna radiation patterns resulting from a control according to embodiments. The thus illustrated antenna radiation patterns may result from an one of the procedures according to FIGS. 1 to 3, as explained above.

As shown in FIG. 4, an antenna radiation pattern of a LOS case may exhibit a narrow antenna lobe (or beam) width and may be directed towards the direction of the transmitter of the received radio waves signal or signals, which is assumed to be 90° herein. As shown in FIG. 4, an antenna radiation pattern of a NLOS case may exhibit a circular antenna characteristic, such as an antenna lobe (or beam) width of 360 degrees, and may thus not exhibit any directivity, which may be the case when reflections of scattered signals arrive in angles of (approximately) 360 degrees.

As described above, various kinds of information may be used for a processor or controller or the like to make a decision about executing a suitable antenna radiation pattern control (such as antenna direction and/or beam width). The antenna radiation pattern control may be suitable for improving data throughput in good SNR/SIR/SINR conditions and/or for improving cell coverage (or, more generally, communicable distance) in weak signal conditions (for example at a cell edge). According to needs and/or preferences, radiation pattern controls may be generated and conveyed to the antenna unit in question.

The fading conditions (such as the radio link parameters) may be continuously followed, and corresponding antenna beam steering controls may be provides (for example based on calculations and/or table lookups) accordingly. Thereby, improved communication quality and/or increased bitrates may be achieved due to the advanced beam steering technique according to exemplary embodiments.

According to exemplary embodiments, any steerable antenna arrangement of the antenna unit may be controlled by the above procedures. Accordingly, the fading-based control technique according to embodiments is independent of the configuration of the antenna unit, as long as its antenna radiation pattern is controllable, and is applicable to any antenna arrangement including, at least one antenna (such as an antenna element or radiator) or a one or two-dimensional antenna array (having a plurality of antennas or antenna elements or radiators).

Generally speaking, for controlling the antenna radiation pattern, the antenna control according to embodiments may affect the design and/or weights and/or signal phases of antennas in an antenna array or the design and/or size of the effective electrically conductive area in an antenna unit with at least one antenna (such as an antenna element or radiator).

Figure 5:
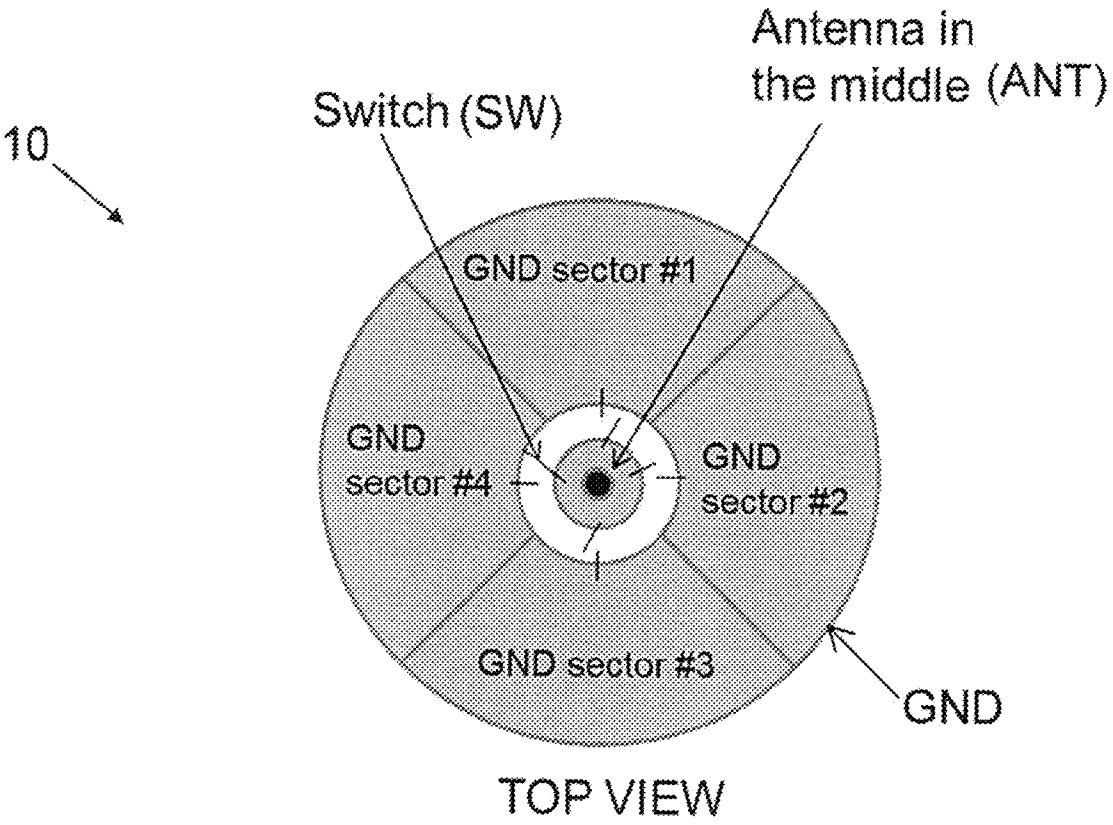
FIG. 5 shows a schematic diagram of a first construction of an apparatus according to exemplary embodiments of this invention.

FIG. 5 shows a schematic diagram of a first construction of an apparatus according to embodiments.

As shown in FIG. 5, an apparatus 10 is an antenna arrangement, controllable according to embodiments which includes an antenna element ANT, an electrically conductive ground plane GNU which is divided into a plurality of electrically isolated parts, and a switching unit SW configured to electrically connect at least one of the plurality of parts of the ground plane GND with a ground potential of the apparatus 10.

The antenna element ANT as such is electrically isolated from the ground plane GND, for example by way of an air gap or an isolator there-between. The parts of the ground plane may also be divided for example by way of an air gap or an isolator there-between, respectively. The antenna element may be any antenna element capable of transmitting and/or receiving electromagnetic radiation. Further, there may also be more than one antenna element. Furthermore, the antenna element may be any one of a system main antenna, a diversity antenna, a MIMO antenna, an alternate antenna or any other special purpose antenna for example sharing functionality between wireless communication systems. For example, the antenna element ANT may be a monopole antenna element, a dipole antenna element, and so on. Also, the antenna element ANT may have any resonant frequency property, for example may be a quarter-wave antenna element, a half-wave antenna element, and so on.

In the exemplary configuration of FIG. 5, the ground plane has a circular/annular shape as an example of a curved basic shape, and it is divided into four parts having a sector shape, respectively. It is noted that the antenna arrangement is not limited to such an example configuration, but different shapes of the ground plane and different numbers of divided parts are equally applicable. For example, the ground plane may have an ellipsoidal shape (as an example of a curved basic shape) with sector-shaped parts, or the ground plane may have a rectangular or polygonal (as an example of a straight-line basic shape) shape with trapezoid-shaped parts. Generally speaking, the ground plane ma have any conceivable shape, such as any curved basic shape, in which case the divided parts thereof have a sector-like basic shape, or any straight-lined basic shape, in which case the divided parts thereof have a trapezoid-like basic shape. Also the number of divided parts may adopt any natural number equal to or larger than two.

The ground plane (or parts thereof) may have any conceivable design or form. For example the ground plane may include a two-dimensional design/form (that is a one-dimensional profile shape in a side view) or a three-dimensional design/form that is a two-dimensional profile shape in as side view). When being three-dimensionally designed/formed, the ground plane may for example be convex, concave, or may have any other (for example combined) appearance. FIG. 4 shows an antenna diagram illustrating two antenna radiation patterns resulting from a control according to exemplary embodiments.

Figure 6:
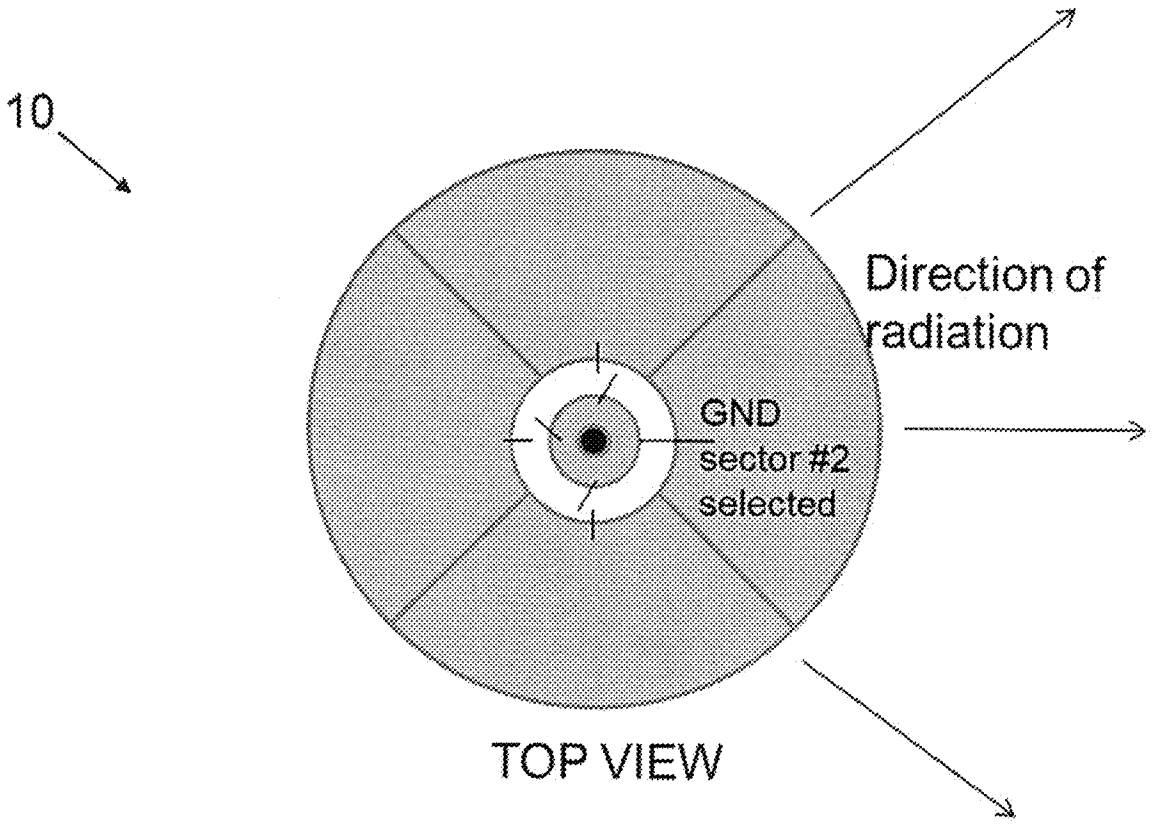
FIG. 6 shows a schematic diagram of an operational example in the first construction of an apparatus according to exemplary embodiments of these teachings.

FIG. 6 shows a schematic diagram of an operational example in the construction of an apparatus according to embodiments.

As indicated above each of the parts (for example sectors) can be switched on and off by the switching unit, respectively. Accordingly, one or more of the parts (for example sectors) can be connected with the ground potential of the apparatus at a time, thereby varying the design and/or size of the effective area of the ground plane and, thus, the antenna radiation pattern. Furthermore, one or more of the parts (for example sectors) can be connected with the alternate sectors at a time thereby varying the effective area of the ground plane and thus, the antenna radiation pattern.

In the example operational situation of FIG. 6, part (for example sector) #2 of the ground plane GND is electrically connected with the part representing the ground potential of the apparatus by way of a corresponding switch on the right side thereof, while the remaining three parts (for example sectors) #1, #3 and #4 of the ground plane GND are unconnected due, to an open state of the respective switches. Thereby, an antenna radiation pattern as indicated in FIG. 6 would result, for example a transmit emission direction in the case of a transmit antenna or transmit antenna usage of a transmit/receive/MIMO/diversity antenna. Similarly, in the case of a receive antenna or receive antenna usage of a transmit/receive/MIMO/diversity antenna, the resulting antenna radiation pattern as indicated in FIG. 6 would represent a receive sensitivity direction.

Figure 7:
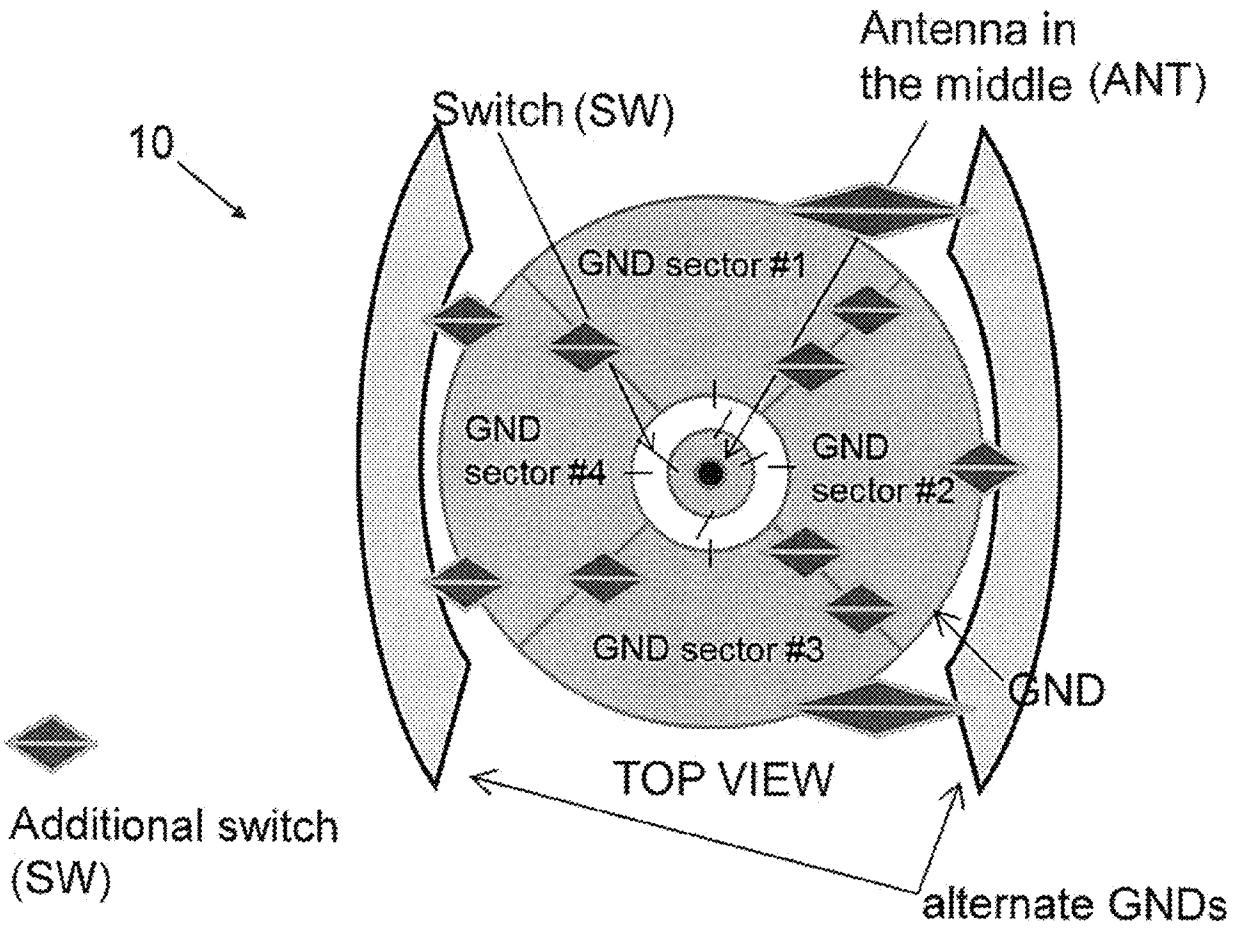
FIG. 7 shows a schematic diagram of a second construction of an apparatus according to exemplary embodiments of these teachings.

FIG. 7 shows a schematic diagram of a second construction of an apparatus according to embodiments.

As shown in FIG. 7, an apparatus 10 is an antenna arrangement, controllable according to embodiments includes an antenna element ANT, art electrically conductive ground plane GND which is divided into a plurality of electrically isolated parts, two alternate ground planes which are electrically conductive, and a switching unit SW configured to electrically connect at least one of the plurality of parts of the ground plane GND with a ground potential of the apparatus 10. Further, the apparatus includes additional switches between the electrically isolated parts of the ground plane and between the ground plane (that is isolated parts thereof) and the alternate ground planes, respectively. The additional switches function to (further) shape the antenna radiation pattern of the antenna arrangement. Accordingly, the additional switches are controllable (by a controller) to this end. The additional switches may form part of the switching unit SW, and may thus be controlled in a coordinated manner.

It is noted that the configuration according to FIG. 7 is for illustrative purposes by way of example only. The additional switches may include only the additional switches between the isolated parts of the ground plane, only the additional switches between the ground plane and the (one or more) alternate ground planes, or both (as illustrated in FIG. 7). The number or additional switches at the various possible positions is not limited in any way. Also as illustrated in FIG. 7, the number of additional switches between isolated parts of the ground plane and/or between any isolated part of the ground plane and an alternate ground plane are not necessarily equal to each other. Further, there does not have to be an additional switch between every pair of adjacent isolated parts of the ground plane and/or an alternate ground plane. The respective additional switches between isolated parts of the ground plane may be disposed at different distances from the center portion and/or the antenna element, respectively.

Further, there may be any conceivable number of alternate ground planes, such as one or more (where two alternate ground planes are illustrated in FIG. 7), and the shape and design lot of the alternate ground planes is not limited in any way but may adopt any shape and/or design/form as described above for the ground plane GND.

As illustrated in FIG. 7, the switching unit SW (that is the additional switches) may connect an electrically conductive ground plane GND (or part thereof) to one or more electrically conductive ground plane(s) GND (or parts thereof). One ground plane may have one or more SW with corresponding controls. As illustrated in FIG. 7, connected electrically conductive ground plane(s) GND may be adjacent or any other alternate electrically conductive ground plane(s) GND designed to be connected together to shape the antenna (radiation) pattern.

As illustrated in FIG. 7, positions of SW itches may vary around the ground plane GND, which may for example be according to design implementation, in order to shape the antenna (radiation) pattern.

Although not illustrated, ground planes (or parts thereof) may overlap each other, and/or ground planes (or parts thereof) may be extended by steps around the center portion and/or the antenna element, and/or ground planes (or parts thereof) may be extended by steps with distance from the center portion and/or the antenna element.

The switching unit and/or the switch/switches may be realized by any conceivable element with electrical (controllable) switching functionality, such as for example diodes, transistors, relays, or the like.

The switching functionalities may for example be embedded to a printed wiring board (PWB), LTCC (Low temperature co-fired ceramic) or the like with control circuitry with routings. Routing length or routing loops on the PWB or the like may be used to adjust antenna radiation pattern(s). The PWB or the like may have electrical components at single or both sides or embedded to layers of the PWB. In some implementations, the PWB rimy have integrated functionalities of one or more of antenna switches, RF path filtering, transceiver, modem, application processor, memory, user interface, positioning receiver, for example.

According to embodiments the antenna radiation pattern of an antenna unit with an antenna arrangement as illustrated in any one FIGS. 5 to 7 is controllable by altering effective (that is switched) GND sector elements and/or planes. Namely, the antenna radiation pattern may be varied in that each of the GND sectors and/or planes (of an arbitrary number) can be switched on and off by a switching element. Thereby, (switching-based) modifications in the orientation of effective GND sectors of the antenna ground plane or planes can be utilized to form a directive antenna beam to different directions. Further, (switching-based) modifications in the number of effective GND sectors of the antenna ground plane or planes can be utilized to form a directive antenna beam with different beam/lobe widths.

Figure 8:
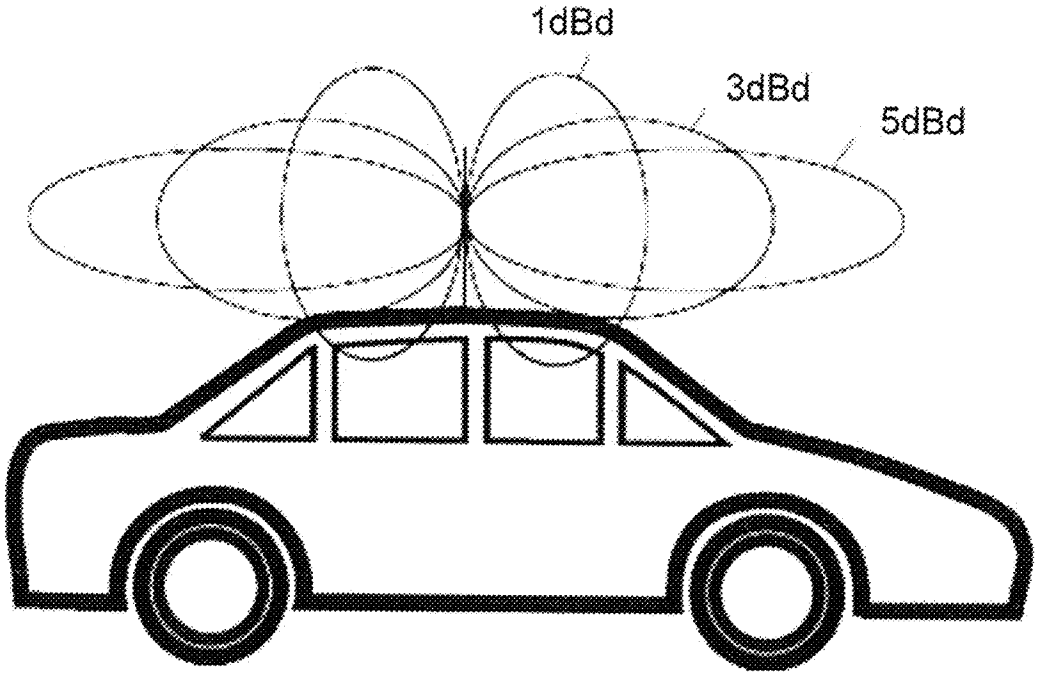
FIG. 8 shows a schematic diagram of a mobile device suitable for use in practicing the exemplary embodiments of this invention.

FIG. 8 shows a schematic diagram of an exemplary mobile device suitable for use in practicing exemplary embodiments.

Figure 9:
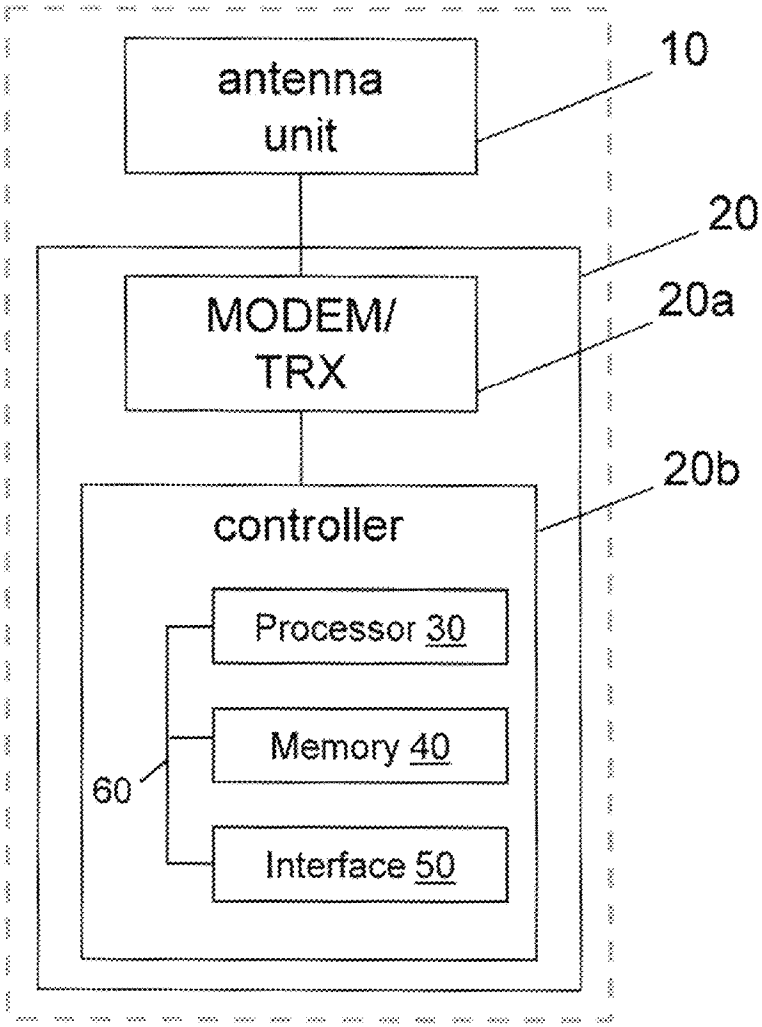
FIG. 9 shows a functional block diagram of an apparatus according to exemplary embodiments of this invention.

As shown in FIG. 8, an apparatus operable for fading-based control according to embodiments, for example the apparatus according to FIG. 9, may be mounted or mountable on any mobile device, such as for example a vehicle. In the exemplary illustration of FIG. 8, the antenna unit may be mounted or mountable for example on the roof of a car. Practically, the apparatus and/or the antenna unit may be placed at any place in/at a car or other vehicle with suitable industrial design, or the apparatus may be integrated into another assembly part or functional module/part of car or other vehicle.

Namely, an antenna arrangement and/or an antenna module (for example including a modem) according to embodiments may be installed in the roof of a car. A USB cable or the like may for example provide a data connection (and power) for a modem and a radio frequency operation of the antenna element.

As indicated in FIG. 8, the antenna unit may be controlled to exhibit different antenna radiation patterns, and a resulting antenna radiation pattern is typically longer (that is it provides for a longer communication distance) the narrower its antenna lobe width is.

Although not illustrated, an apparatus operable for fading-based control according to embodiments may be mounted or mountable on any conceivable mobile device, including a communication terminal equipment or user equipment of any conceivable cellular/radar/satellite communication system or any other positioning/measuring system. For example, the apparatus may be mounted or mountable at a terminal device of a 2G/3G/4G communication system, a WLAN/WiFi communication system, a Bluetooth communication system, as a receive/transmit/receive and transmit/diversity/MIMO antenna, or the like.

As indicated above, depending on the type of wireless communication link to be served/realized by way of the antenna unit in question, the communication counterpart may be a mobile device or satellite or a radio communication system infrastructure (including relays, routers, etc). Referring to the configuration of FIG. 8, a car-to-car communication may be served/realized when the communication counterpart is also a car.

While embodiments are applicable for any mobile device in any conceivable use case, application in an automotive environment may be particularly effective. This is because a vehicle or car is typically moving reasonably fast in varying environments. Accordingly applying embodiments in an automotive environment is effective for achieving desirable reception or radio link performance, for example in terms of reception sensitivity of a desired radio wave signal and/or reception data throughput even for mobile devices moving in varying environments.

FIG. 9 shows a functional block diagram of an apparatus according to embodiments.

As shown in FIG. 9, an apparatus (or electronic device) according to embodiments may include an antenna unit 10 and a processing unit 20, wherein the processing unit 20 may include a modem/transceiver 20*a* and a controller 20*b*.

The antenna unit 10 may for example include one as exemplified with reference to FIGS. 5 to 7. The antenna unit is for example applicable for use as or in an antenna module or an antenna module with electronics or a vehicle factory assembly part, or a vehicle after sale assembly part, or a vehicle service upgrade part, or the like according to embodiments.

Controlling unit 20*b* may be configured to perform fading-based control according to embodiments, as described above, that is the procedure as exemplified with reference to FIGS. 1 to 3. Component 20*a* may be realized by a feeding/communication unit which may include at least one of a modem and a transceiver unit (in the case of a transmit/receive antenna or corresponding usage). Component 20*b* may be realized by a processing system or processor or, as exemplarily illustrated, by an arrangement of a processor 30, a memory 40 and an interface 50, which are connected by a link or bus 60. Memory 40 may store respective programs assumed to include program instructions or computer program code that, when executed by the processor 30, enables the respective electronic device or apparatus to operate in accordance with the embodiments. For example, memory 40 may store a computer-readable implementation of a control procedure as illustrated in any of FIGS. 1 to 3. Further, memory 40 may store one or more look-up tables for implementing the control of the antenna radiation pattern with respect to the one or more parameters used in this regard, such as look-up tables for different combinations of conceivable parameters such as fading scenario and/or fading-related reception parameter/parameters and/or auxiliary data.

According to embodiments, all (or some) circuitries required for the aforementioned functionalities may be embedded in the same circuitry, a system in package, a system on chip, a module, a LTCC (Low temperature co-fired ceramic) or the like, as indicated by the dashed line in FIG. 9.

Irrespective of the illustration of FIG. 9, an apparatus (or electronic device) according to embodiments may include processing unit 20 only which is connectable to the antenna unit 10, or an apparatus (or electronic device) according to embodiments may include controlling unit 20*b* only, which is connectable to antenna unit 10 (via modem/transceiver 20*a* or not).

According to embodiments, the control procedure as illustrated in any of FIGS. 1 to 3 may be executed in/by controlling unit 20 (that is in cooperation between modem/transceiver 20*a* and controller 20*b*) or in/by controller 20*b* as such.

Apparatus according to embodiments (irrespective of its realization with respect to the illustration or FIG. 9) is configured to receive at least one radio wave signal via an antenna unit, to detect fading conditions in relation to the receipt of the at least one radio wave signal, and to control an antenna radiation pattern of the antenna unit in terms of antenna lobe width on the basis of the detected fading conditions. For example, depending on the realization with respect to the illustration of FIG. 9, the fading conditions may be detected, for example corresponding information may be extracted, either at/by modem/transceiver 20*a* or controller 20*b*.

In various variants, the apparatus according to embodiments (irrespective of its realization with respect to the illustration of FIG. 9) may be configured to determine a predefined fading scenario and to adjust the antenna lobe width in accordance with the determined lading scenario, and/or to measure at least one fading-related reception parameter and to adjust the antenna lobe width in accordance with the measured at least one fading-related reception parameter, and/or to detect an incoming signal direction in relation to receipt of the at least one radio wave signal and to control the antenna radiation pattern of the antenna unit in terms of antenna lobe direction on the basis of the detected incoming signal direction, and/or to retrieve auxiliary data relating to at least one of geographical and infrastructural environment information and to control the antenna radiation pattern of the antenna unit in terms of at least one of antenna lobe width and antenna lobe direction on the basis of the retrieved auxiliary data.

As outlined above, the communication counterpart, to which the apparatus is to transmit and/or from which the apparatus is to receive, may be any entity operable to communicate with the apparatus. For example, the communication counterpart may be a base station or any other access point of a communication system and a mobile device (when the wireless path corresponds to a downlink wireless link) or any mobile device (when the wireless path corresponds to a D2D, V2I, V2V, V2R wireless link). In embodiments, the apparatus may be able to define its own location in geographical area and/or the communication counterpart's location, and the apparatus may be capable of defining a parameter set in order to aim/direct an antenna beam towards the communication counterpart. The apparatus may define its own location, for example, with satellite positioning methods, network positioning methods, or with special purpose sensors, such as a gyroscope. The communication counterpart's location may be obtained from a network server on the basis of an identifier, a communication with the communication counterpart, from the apparatus memory on the basis of an identifier of the communication counterpart or the like.

In embodiments, the apparatus memory (such as memory 40 in FIG. 9) may maintain and update a (preferable or optimal) parameter set. Such (preferable or optimal) parameter set may for example relate to road sections or the like. Typically, a vehicle with a driver follows the same route between home-work-home-mall-hobbies-home the like and the apparatus may pick a preferable or optimal parameter set from the memory for each road section (based on pre-stored route information). The apparatus may learn poor radio performance road sections and may with trial-and-error update the database for a better parameter set for example for tunnels etc.

In general terms, the respective devices/apparatuses (and/or parts thereof) may represent means for performing respective operations and/or exhibiting respective functionalities, and/or the respective devices (and/or parts thereof) may have functions for performing respective operations and/or exhibiting respective functionalities.

It is noted that embodiments are not limited to such configuration as depicted in FIG. 9, but any configuration capable of realizing the structural and/or functional features described herein is equally applicable.

It is further noted that Figures to 7 and 9 represent simplified schematic block diagrams. In FIG. 9, the solid line blocks are configured to perform respective operations as described herein. The entirety of solid line blocks are configured to perform the methods and operations as described herein, respectively. With respect to FIG. 9, it is to be noted that the individual blocks are meant to illustrate respective functional blocks implementing a respective function, process or procedure, respectively. Such functional blocks are implementation-independent, that is they may be implemented by means of any kind of hardware or software, respectively. The arrows and lines interconnecting individual blocks are meant to illustrate an operational coupling there-between, which may be a physical and/or logical coupling, which on the one hand is implementation-independent (for example wired or wireless) and on the other hand may also include an arbitrary number of intermediary functional entities (not shown). The direction of an arrow illustrates the direction in which certain operations are performed and/or the direction in which certain data is transferred.

Further, in FIGS. 5 to 7 and 9, only those structural/functional blocks are illustrated, which relate to any one of the (specific) methods, procedures and functions according to embodiments. A skilled person will acknowledge the presence of any other conventional functional blocks required for an operation of respective structural arrangements, such as for example a power supply, a central processing unit, respective memories or the like. Amongst others, memories are provided for storing programs or program instructions for controlling the individual functional entities to operate as described herein.

When in the above description it is stated that the processor (or some other means such as a processing system) is configured to perform some function, this is to be construed to be equivalent to a description stating that at least one processor, potentially in cooperation with computer program code stored in the memory of the respective apparatus, is configured to cause the apparatus to perform at least the thus mentioned function.

In general, it is to be noted that respective functional blocks or elements according to above-described aspects can be implemented by any known means, either in hardware and/or software/firmware, respectively, if it is only adapted to perform the described functions of the respective parts. The mentioned method steps can be realized in individual functional blocks or by individual devices, or one or more of the method steps can be realized in a single functional block or by a single device.

Generally, any structural means such as a processing system, processor or other circuitry may refer to one or more of the following: (a) hardware-only circuit implementations such as implementations in only analog and/or digital circuitry) and (b) combinations of circuits and software (and/or firmware), such as (as applicable): (i) a combination of processor(s) or (ii) portions of processor(s)/software (including digital signal processor(s)), software, and memory(ies) that work together to cause an apparatus, such as a mobile phone or server, to perform various functions) and (c) circuits, such as a microprocessor(s) or a portion of a microprocessor(s), that require software or firmware for operation, even if the software or firmware is not physically present. Also, it may also cover an implementation of merely a processor (or multiple processors) or portion of a processor and its (or their) accompanying software and/or firmware, any integrated circuit, or the like.

Generally, an procedural step or functionality is suitable to be implemented as software/firmware or by hardware without changing the ideas of the present disclosure. Such software may be software code independent and can be specified using any known or future developed programming language, such as for example Java, C++, C, and Assembler, as long as the functionality defined by the method steps is preserved. Such hardware may be hardware type independent and can be implemented using any known or future developed hardware technology or any hybrids of these, such as MOS (Metal Oxide Semiconductor), CMOS (Complementary MOS), BiMOS (Bipolar MOS), BiCMOS (Bipolar CMOS), ECL (Emitter Coupled Logic), TTL (Transistor-Transistor Logic), etc., using for example ASIC (Application Specific IC (Integrated Circuit)) components, SIP (system in package), SOC (System on chip), FPGA (Field-programmable Gate Arrays) components, CPLD (Complex Programmable Logic Device) components or DSP (Digital Signal Processor) components. A device/apparatus may be represented by a semiconductor chip, a chipset, or a (hardware) module including such chip or chipset; this, however does not exclude the possibility that a functionality of a device/apparatus or module, instead of being hardware implemented be implemented as software in a (software) module such as a computer program or a computer program product including executable software code portions for execution/being run on a processor. A device may be regarded as a device/apparatus or as an assembly of more than one device/apparatus, whether functionally in cooperation with each other or functionally independent of each other but in a same device housing, industrial design, for example.

Apparatuses and/or means or parts thereof can be implemented as individual devices, but this does not exclude that they may be implemented in a distributed fashion throughout the system, as long as the functionality of the device is preserved. Such and similar principles are to be considered as known to a skilled person.

Software in the sense of the present description includes software code as such including code means or portions or a computer program or a computer program product for performing the respective functions, as well as software (or a computer program or a computer program product) embodied on a tangible medium such as a computer-readable (storage) medium having stored thereon a respective data structure or code means/portions or embodied in a signal or in a chip, potentially during processing thereof.

The present invention also covers any conceivable combination of method steps and operations described above, and any conceivable combination of nodes, apparatuses, modules or elements described above, as long as the above-described concepts of methodology and structural arrangement are applicable.

In summary, it can be said that the present disclosure and/or embodiments thereof provide measures for fading-based control of an antenna radiation pattern. Such measures may for example include reception of at least one radio wave signal via an antenna unit, detection of fading conditions in relation to the received at least one radio wave signal, and control of an antenna radiation pattern of the antenna unit, at least in terms of antenna lobe width, on the basis of the detected fading conditions.

Even though the present disclosure and/or embodiments are described above with reference to the examples according to the accompanying drawings, it is to be understood that the are not restricted thereto. Rather, it is apparent to those skilled in the art that the present disclosure can be modified in many ways without departing from the scope of the inventive ideas as disclosed herein.

LIST OF ACRONYMS AND ABBREVIATIONS

BB Baseband
D2D Device to Device
DL Downlink
FDD Frequency Division Duplex
HSPA High Speed Packet Access
LOS Line-of-Sight
LTCC Low temperature co-fired ceramic
LTE Long Term Evolution
LTE-A Long Term Evolution Advanced
MIMO Multiple Input Multiple Output
NLOS Non-Line-of-Sight
PWB Printed Wiring Board
RF Radio Frequency
RSSI Received Signal Strength Indicator
RX Receive/Reception
SINR Signal-to-Interference-plus-Noise Ratio
SIR Signal-to-Interference-Ratio
SNR Signal-to-Noise Ratio
TDD Time Division Duplex
TX Transmit/Transmission
UE User Equipment
USB Universal Serial Bus
UL Uplink
V2I Vehicle to Infrastructure
V2R Vehicle to Roadside
V2V Vehicle to Vehicle
WLAN Wireless Local Area Network

What is claimed is:

1. A method, implemented by a mobile device, of controlling an antenna radiation pattern, the method comprising:

receiving at least one radio wave signal via an antenna unit;

detecting a fading condition in relation to the received at least one radio wave signal, the detecting comprising determining a presence of one of a plurality of predefined fading scenarios; and controlling an antenna radiation pattern of the antenna unit in terms of antenna lobe width on the basis of the detected fading condition, the controlling comprising adjusting the antenna lobe width in accordance with the determined fading scenario, wherein the predefined fading scenarios comprise a line-of-sight (LOS) scenario and at least one scattering (NLOS) scenario, and the method further includes performing an initial determination on whether the fading condition belongs to one of the LOS scenario and the NLOS scenario, when the fading condition is determined to belong to the LOS scenario, adjusting the antenna lobe width to be a predetermined antenna lobe width corresponding to the LOS scenario without performing further measurements of at least one fading-related reception parameter, and when the fading condition is determined to belong to the NLOS scenario, performing further measurements of at least one fading-related reception parameter and adjusting the antenna lobe width to be one of a plurality of antenna lobe widths corresponding to the NLOS scenario.

2. The method according to claim 1, wherein the at least one fading-related reception parameter comprises one or more of:

at least one parameter indicative of signal propagation conditions on a radio link between the antenna unit and a communication counterpart, and at least one antenna parameter of the antenna unit.

3. The method according to claim 1, further comprising:

detecting an incoming signal direction in relation to the at least one received radio wave signal; and controlling the antenna radiation pattern of the antenna unit in terms of antenna lobe direction on the basis of the detected incoming signal direction.

4. The method according to claim 1, comprising:

retrieving auxiliary data relating to at least one of geographical and infrastructural environment information; and controlling the antenna radiation pattern of the antenna unit in terms of at least one of antenna lobe width and antenna lobe direction on the basis of the retrieved auxiliary data.

5. The method according to claim 1, wherein:

the antenna unit comprises a steerable antenna arrangement including at least one antenna or a one- or two-dimensional antenna array, and the mobile device comprises at least one of a vehicle, a computer, a satellite, a communication equipment, and a communication terminal equipment.

6. A mobile device that controls an antenna radiation pattern, the mobile device comprising:

circuitry configured to receive at least one radio wave signal via an antenna unit;

detect a fading condition in relation to the received at least one radio wave signal, the detecting comprising determining a presence of one of a plurality of predefined fading scenarios; and control an antenna radiation pattern of the antenna unit in terms of antenna lobe width on the basis of the detected fading condition, the controlling comprising adjusting the antenna lobe width in accordance with the determined fading scenario, wherein the predefined fading scenarios comprise a line-of-sight (LOS) scenario and at least one scattering (NLOS) scenario, and the circuitry is further configured to perform an initial determination on whether the fading condition belongs to one of the LOS scenario and the NLOS scenario, when the fading condition is determined to belong to the LOS scenario, the circuitry is configured to adjust the antenna lobe width to be a predetermined antenna lobe width corresponding to the LOS scenario without performing further measurements of at least one fading-related reception parameter, and when the fading condition is determined to belong to the NLOS scenario, the circuitry is configured to perform further measurements of at least one fading-related reception parameter and adjust the antenna lobe width to be one of a plurality of antenna lobe widths corresponding to the NLOS scenario.

7. The mobile device according to claim 6, wherein the at least one fading-related reception parameter comprises one or more of:

at least one parameter indicative of signal propagation conditions on a radio link between the antenna unit and a communication counterpart, and at least one antenna parameter of the antenna unit.

8. The mobile device according to claim 6, wherein the circuitry is configured to:

detect an incoming signal direction in relation to the at least one received radio wave signal; and control the antenna radiation pattern of the antenna unit in terms of antenna lobe direction on the basis of the detected incoming signal direction.

9. The mobile device according to claim 6, wherein the circuitry is configured to:

retrieve auxiliary data relating to at least one of geographical and infrastructural environment information; and control the antenna radiation pattern of the antenna unit in terms of at least one of antenna lobe width and antenna lobe direction on the basis of the retrieved auxiliary data.

10. The mobile device according to claim 6, wherein:

the antenna unit comprises a steerable antenna arrangement including at least one antenna or a one- or two-dimensional antenna array, the mobile device further comprises the antenna unit, and the mobile device comprises at least one of a vehicle, a computer, a satellite, a communication equipment, and a communication terminal equipment.

11. A non-transitory computer-readable medium including computer readable instructions stored thereon, the computer readable instructions being executable by a mobile device to cause the mobile device to perform a method comprising:

receiving at least one radio wave signal via an antenna unit of the mobile device;

detecting a fading condition in relation to the received at least one radio wave signal, the detecting comprising determining a presence of one of a plurality of predefined fading scenarios; and controlling an antenna radiation pattern of the antenna unit in terms of antenna lobe width on the basis of the detected fading condition, the controlling comprising adjusting the antenna lobe width in accordance with the determined fading scenario, wherein the predefined fading scenarios comprise a line-of-sight (LOS) scenario and at least one scattering (NLOS) scenario, and the method further includes performing an initial determination on whether the fading condition belongs to one of the LOS scenario and the NLOS scenario, when the fading condition is determined to belong to the LOS scenario, adjusting the antenna lobe width to be a predetermined antenna lobe width corresponding to the LOS scenario without performing further measurements of at least one fading-related reception parameter, and when the fading condition is determined to belong to the NLOS scenario, performing further measurements of at least one fading-related reception parameter and adjusting the antenna lobe width to be one of a plurality of antenna lobe widths corresponding to the NLOS scenario.

12. The non-transitory computer-readable medium according to claim 11, wherein the at least one fading-related reception parameter comprises one or more of:

at least one parameter indicative of signal propagation conditions on a radio link between the antenna unit and a communication counterpart, and at least one antenna parameter of the antenna unit.

13. The non-transitory computer-readable medium according to claim 11, wherein the method further comprises:

detecting an incoming signal direction in relation to at the least one received radio wave signal; and controlling the antenna radiation pattern of the antenna unit in terms of antenna lobe direction on the basis of the detected incoming signal direction.

14. The non-transitory computer-readable medium according to claim 11, wherein the method further comprises:

retrieving auxiliary data relating to at least one of geographical and infrastructural environment information; and controlling the antenna radiation pattern of the antenna unit in terms of at least one of antenna lobe width and antenna lobe direction on the basis of the retrieved auxiliary data.

15. The non-transitory computer-readable medium according to claim 11, wherein:

the antenna unit comprises a steerable antenna arrangement including at least one antenna or a one- or two-dimensional antenna array, the mobile device further comprises the antenna unit, and the mobile device comprises at least one of a vehicle, a computer, a satellite, a communication equipment, and a communication terminal equipment.

16. The method according to claim 1, wherein the at least one received signal includes at least two received signals that are used for carrier aggregation in a Long Term Evolution (LTE) system and are received from a single base station.

17. The method according to claim 1, wherein the at least one received signal includes at least two received signals that are received from different communication counterparts which use different radio access technologies.

* * * * *

UNITED STATES PATENT AND TRADEMARK OFFICE

CERTIFICATE OF CORRECTION

PATENT NO. : 9,318,799 B2
APPLICATION NO. : 13/853220
DATED : April 19, 2016
INVENTOR(S) : Seppo Olavi Rousu et al.

It is certified that error appears in the above-identified patent and that said Letters Patent is hereby corrected as shown below:

On the title page, Item (30), the Foreign Application Priority Data Information has been omitted. Item (30) should read:

--(30) Foreign Application Priority Data

Apr. 5, 2012 (GB) .....1206165.1--

Signed and Sealed this
Nineteenth Day of July, 2016

Michelle K. Lee

Michelle K. Lee
*Director of the United States Patent and Trademark Office*